US006641062B1

(12) United States Patent
Chen

(10) Patent No.: US 6,641,062 B1
(45) **Date of Patent: *Nov. 4, 2003**

(54) FLOW CONTROL STRUCTURE OF A GARDENING PISTOL NOZZLE

(75) Inventor: Chin-Yuan Chen, Chang-Hua Hsien (TW)

(73) Assignee: Shin Tai Spurt Water of the Garden Tools Co., Ltd., Chang-Hua Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/287,016

(22) Filed: Nov. 4, 2002

(51) Int. Cl.[7] ..... B05B 7/02; B05B 9/01; B05B 1/30

(52) U.S. Cl. ..... 239/526; 239/569; 239/583; 239/525

(58) Field of Search ..... 239/526, 525, 239/569, 583; 251/103; 141/98

(56) References Cited

U.S. PATENT DOCUMENTS 5,967,421 A * 10/1999 Wang ..... 239/526
5,967,422 A * 10/1999 Wang ..... 239/526
6,007,003 A * 12/1999 Wang ..... 239/525
6,173,911 B1 * 1/2001 Hui-Chen ..... 239/526
6,260,774 B1 * 7/2001 Erickson ..... 239/526
6,382,529 B1 * 5/2002 Wu ..... 239/525
6,454,187 B1 * 9/2002 Wang ..... 239/526

* cited by examiner

*Primary Examiner*—Michael Mar
*Assistant Examiner*—Darren Gorman
(74) *Attorney, Agent, or Firm*—Harrison & Egbert

(57) ABSTRACT

A gardening pistol nozzle is provided with an automatic flow control structure including an inner retaining seat located in a handle of the pistol nozzle, two shifting mechanisms located in the handle, and an outer retaining seat located in a control knob of the pistol nozzle. The inner retaining seat and the outer retaining seat are provided with a series of teeth. The control knob is pivoted to the handle such that the outer retaining seat is pressed against by the two shifting mechanisms which are used to actuate the outer retaining seat to slide so as to result in engagement or disengagement of the teeth of the outer retaining seat with the teeth of the inner retaining seat.

4 Claims, 14 Drawing Sheets

FLOW CONTROL STRUCTURE OF A GARDENING PISTOL NOZZLE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

1. Field of the Invention

The present invention relates generally to a gardening sprinkler, and more particularly to a pistol nozzle of the gardening sprinkler.

2. Background of the Invention

As shown in FIG. 1, a gardening pistol nozzle of the prior art comprises a control lever 10 and a retaining piece 11. The control lever 10 is provided at one end with a retaining edge 13. The retaining piece 11 is provided with a toothed side 12 opposite in location to the retaining edge 13 of the control lever 10. The control lever 10 is used for regulating the flow of water to the nozzle head. The control lever can be so set as to regulate a constant flow of water in conjunction with the retaining piece 11. As the retaining edge 13 of the control lever 10 is retained at a specific position of the toothed side 12 of the retaining piece 11, the constant flow of water is set without calling for the use of one hand of a user of the pistol nozzle to keep pressing the control lever 10. However, the toothed side 12 of the retaining piece 11 and the retaining edge 13 of the control lever 10 are susceptible to damage which is caused by mechanical friction. In addition, the control lever 10 can not be so set that the retaining edge 13 is free from the confinement of the toothed side 12. In another words, the control lever 10 lacks versatility. Moreover, both the control lever 10 and the retaining piece 11 are so exposed that they are vulnerable to damage by impact.

BRIEF SUMMARY OF THE INVENTION

The primary objective of the present invention is to provide a gardening pistol nozzle which is versatile in design and is free of the deficiencies of the prior art pistol nozzle described above with reference to FIG. 1.

In keeping with the principle of the present invention, the foregoing objective of the present invention is attained by the gardening pistol nozzle comprising a nozzle head, a handle, an inner retaining seat, a control knob, an outer retaining seat, and two shifting members. The inner retaining seat is disposed in the handle, while the outer retaining seat is disposed in the control knob. The engagement and the disengagement of the inner retaining seat with the outer retaining seat are regulated by the two shifting members.

The features, functions, and advantages of the present invention will be more readily understood upon a thoughtful deliberation of the following detailed description of two preferred embodiments of the present invention with reference to the accompanying drawings.

DETAILED DESCRIPTION OF THE INVENTION

Figure 1:
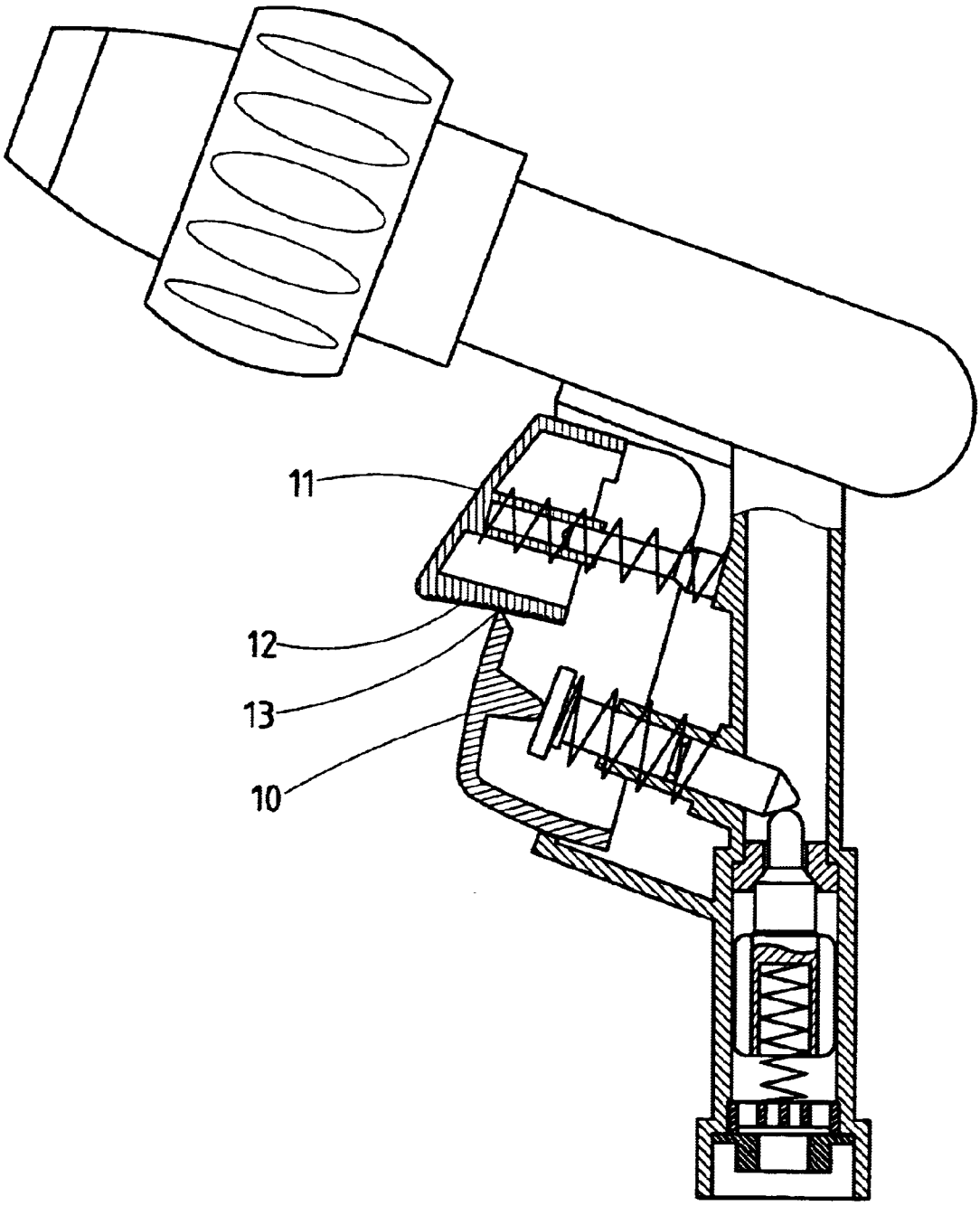
FIG.1 PRIOR ART
FIG. 1 shows a sectional schematic view of a gardening pistol nozzle of the prior art.
Figure 2:
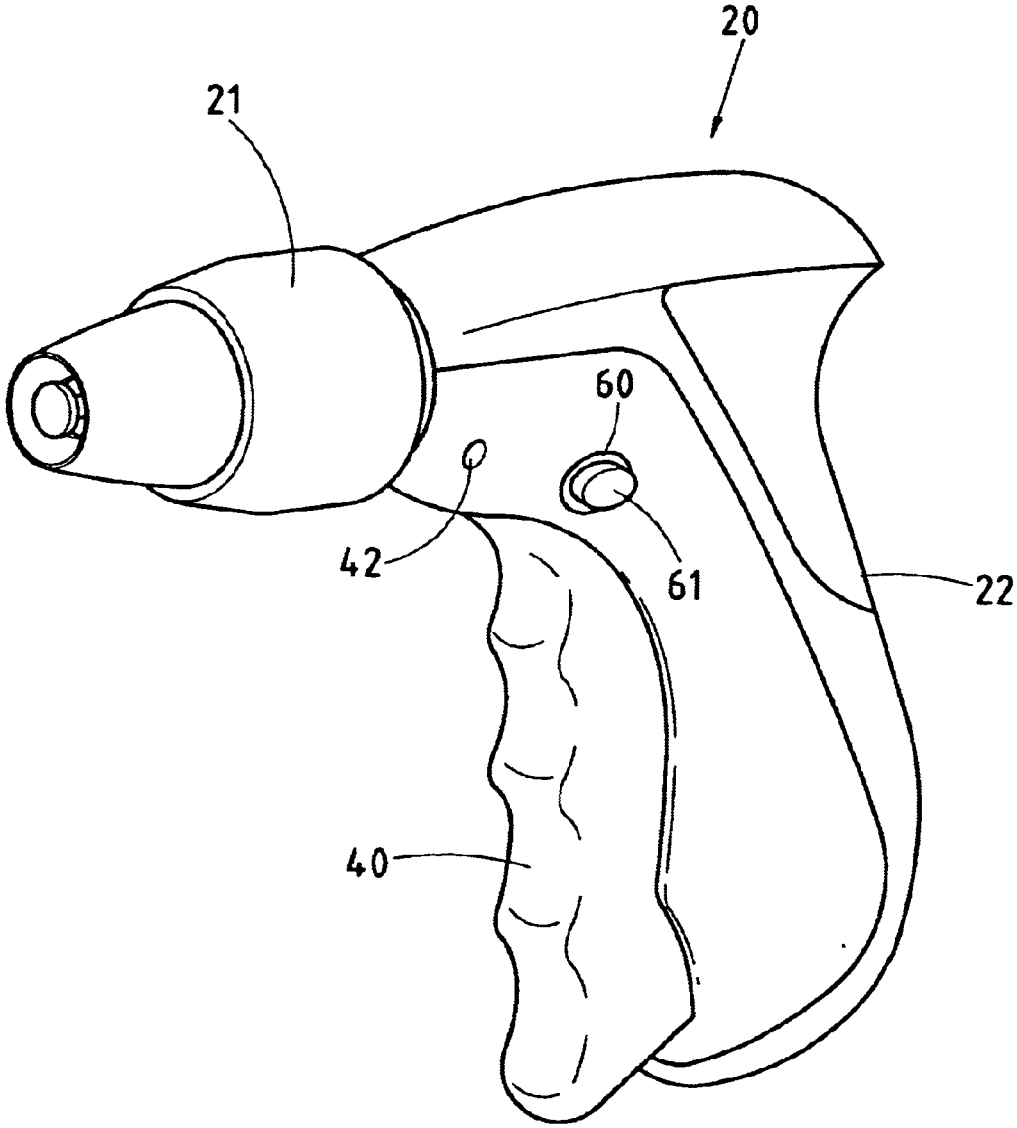
FIG. 2 shows a perspective view of a first preferred embodiment of the present invention.
Figure 3:
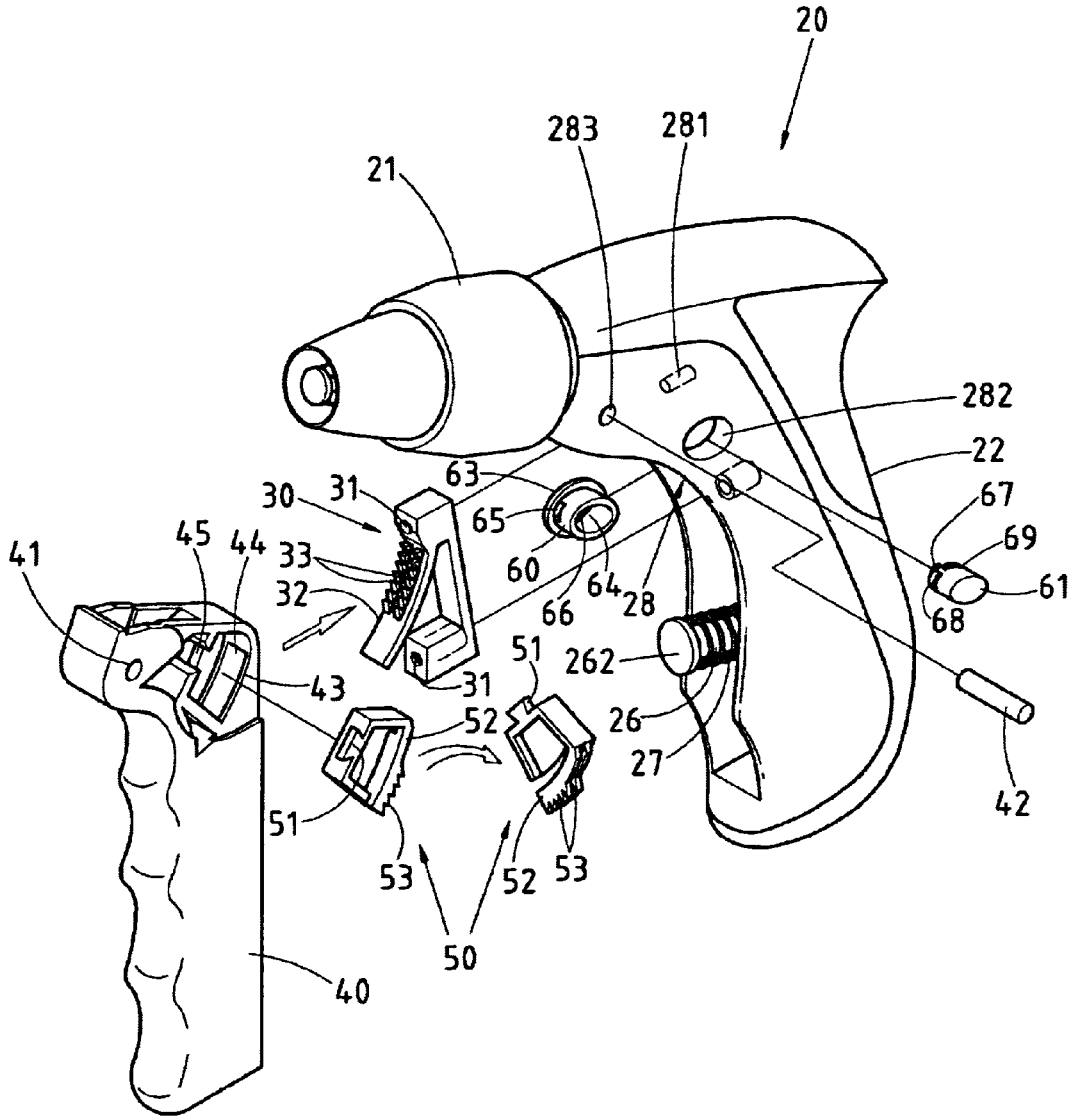
FIG. 3 shows an exploded perspective view of the first preferred embodiment of the present invention.
Figure 4:
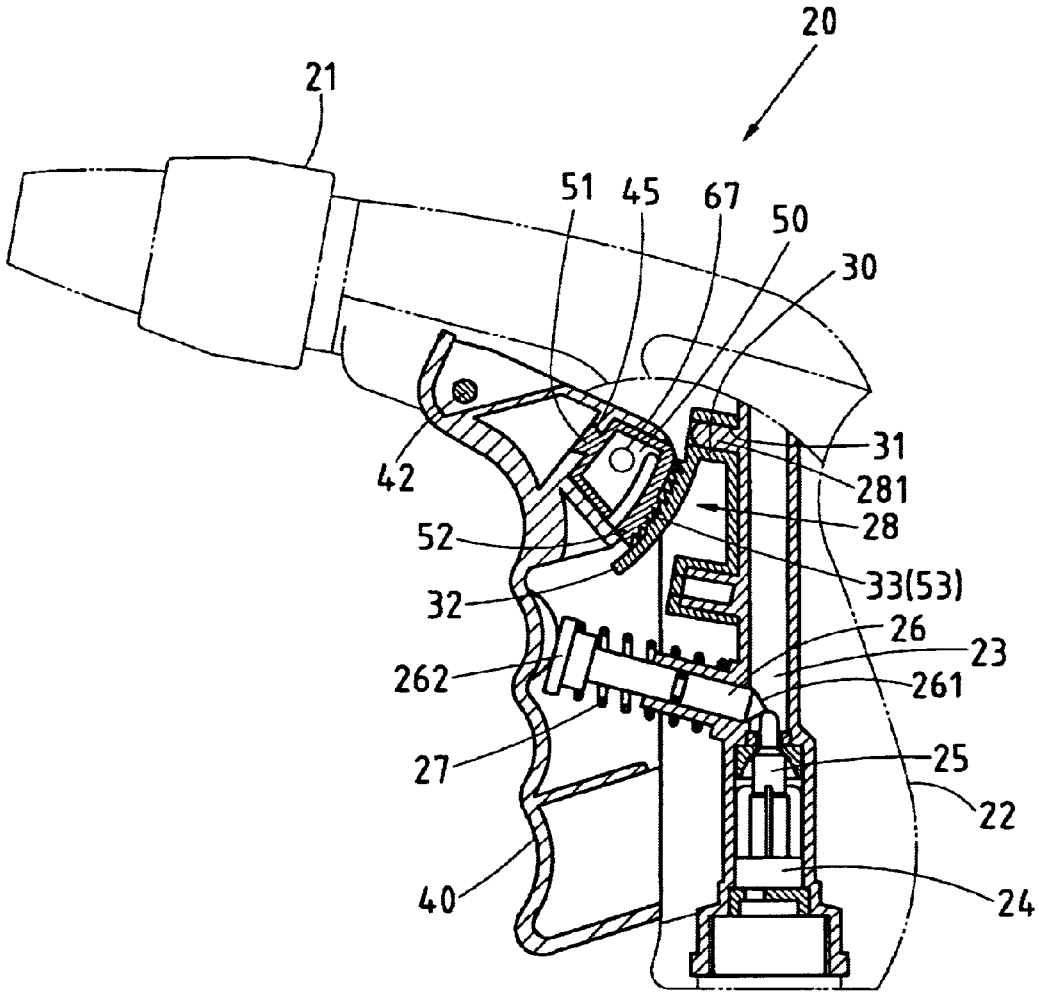
FIG. 4 is a side sectional view of the first preferred embodiment of the present invention.

As shown in FIGS. 2–5, a gardening pistol nozzle 20 embodied in the present invention comprises a nozzle head 21, a handle 22, an inner retaining seat 30, a control knob 40, an outer retaining seat 50, and two shifting members.

The nozzle head 21 is perpendicular to the handle 22. The handle 22 is provided in the interior with a water channel 23 extending along the longitudinal direction thereof, and a valve 24 which is provided with a valve rod 25 for regulating the passage of water. The valve rod 25 is in contact with an inner end 261 of a link rod 26. The link rod 26 has an outer end 262 and is fitted into a spring 27. The handle 22 is further provided in the interior with an assembly slot 28 which is located over the link rod 26 and is provided with a locating projection 281, two through holes 282 corresponding to each other, and two pivoting holes 283 corresponding to each other.

The inner retaining seat 30 is provided with a locating hole 31 and is disposed in the assembly slot 28 of the handle 22 such that the inner retaining seat 30 is located in place by the locating projection 281 which is fitted into the locating hole 31 of the inner retaining seat 30. The inner retaining seat 30 is further provided with an elastic piece 32 which is provided with two rows of unidirectional teeth 33.

The control knob 40 is provided with a pivoting hole 41 and is pivoted with the handle 22 by a pivot 42 which is received in the pivoting hole 41 of the control knob 40 and the pivoting holes 283 of the assembly slot 28 of the handle 22. The side wall of the control knob 40 comes in contact with the outer end 262 of the link rod 26 of the handle 22. The control knob 30 is provided in the top end with an assembly slot 43, an opening 44 opposite to the elastic piece 32 of the inner retaining seat 30, and a dovetail groove 45.

The outer retaining seat 50 is provided with a dovetail block 51 and is disposed in the assembly slot 43 of the control knob 40 such that the dovetail block 51 of the outer retaining seat 50 is slidably fitted into the dovetail groove 45 of the control knob 40. The outer retaining seat 50 is further provided with an elastic piece 52 which is provided with two rows of teeth 53. The teeth 53 are engageable with the teeth 33 of the inner retaining seat 30 via the opening 44 of the control knob 40.

The two shifting members are formed of button seats 60, and buttons 61, 62. The button seats 60 are fitted into the through hole 282 of the assembly slot 28 of the handle 22 such that a flange 63 of the button seats 60 is located between the through hole 282 and the control knob 40. The button seats 60 are provided with a through slot 64 which is in turn provided with a stop slot 65 and a locating edge 66. The buttons 61 and 62 are pivoted in the through slot 64 of the button seats 60 such that the buttons 61 and 62 jut out of the through holes 282, and such that a projection 67 presses against the outer retaining seat 50. The buttons 61 and 62 are provided with a block 68 corresponding to the stop slot 65 of the through slot 64, and a recess 69 corresponding to the locating edge 66, thereby preventing the buttons 61 and 62 from slipping out.

Figure 5:
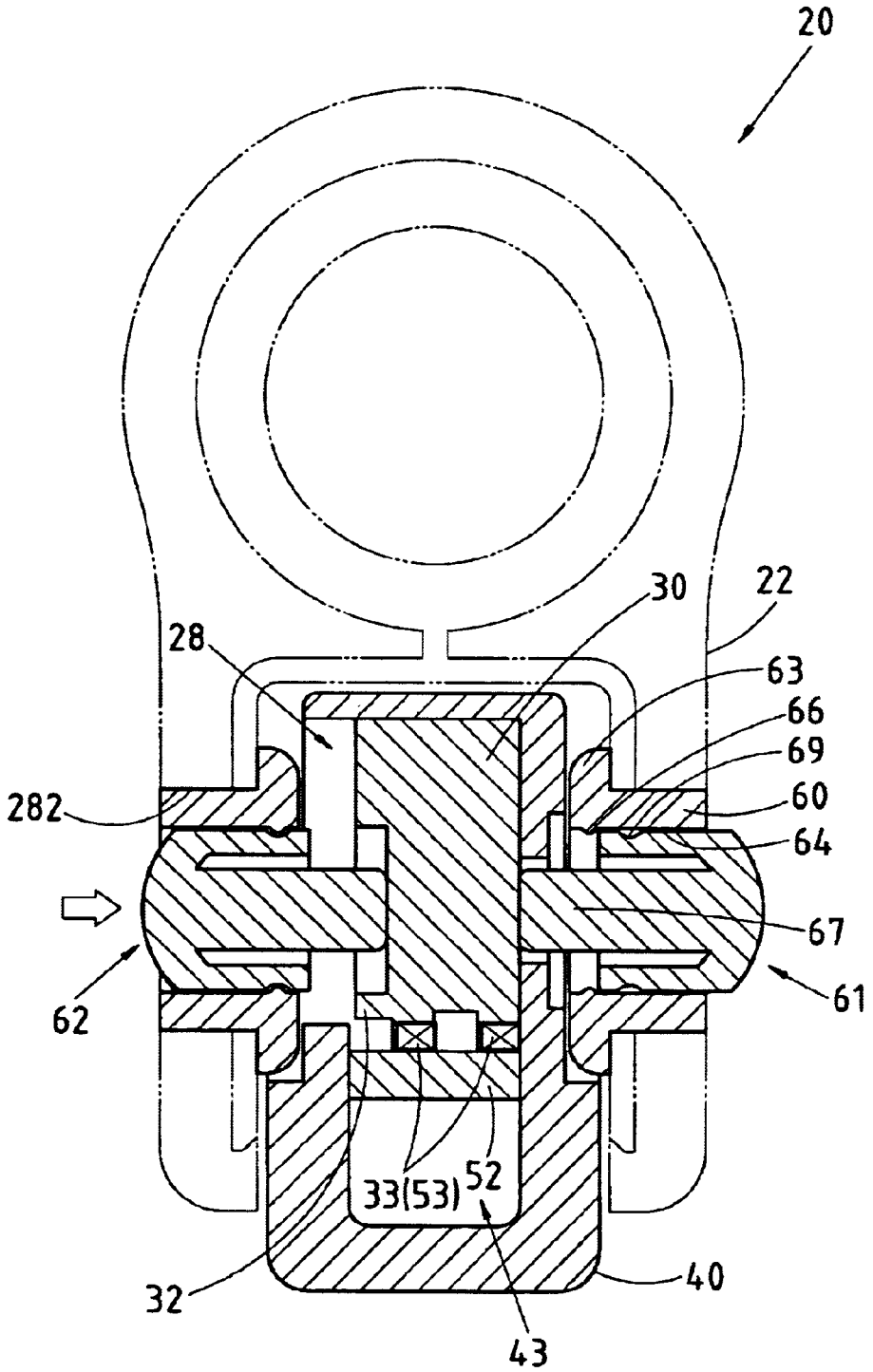
FIG. 5 shows a top sectional view of the first preferred embodiment as shown in FIG. 4.
Figure 6:
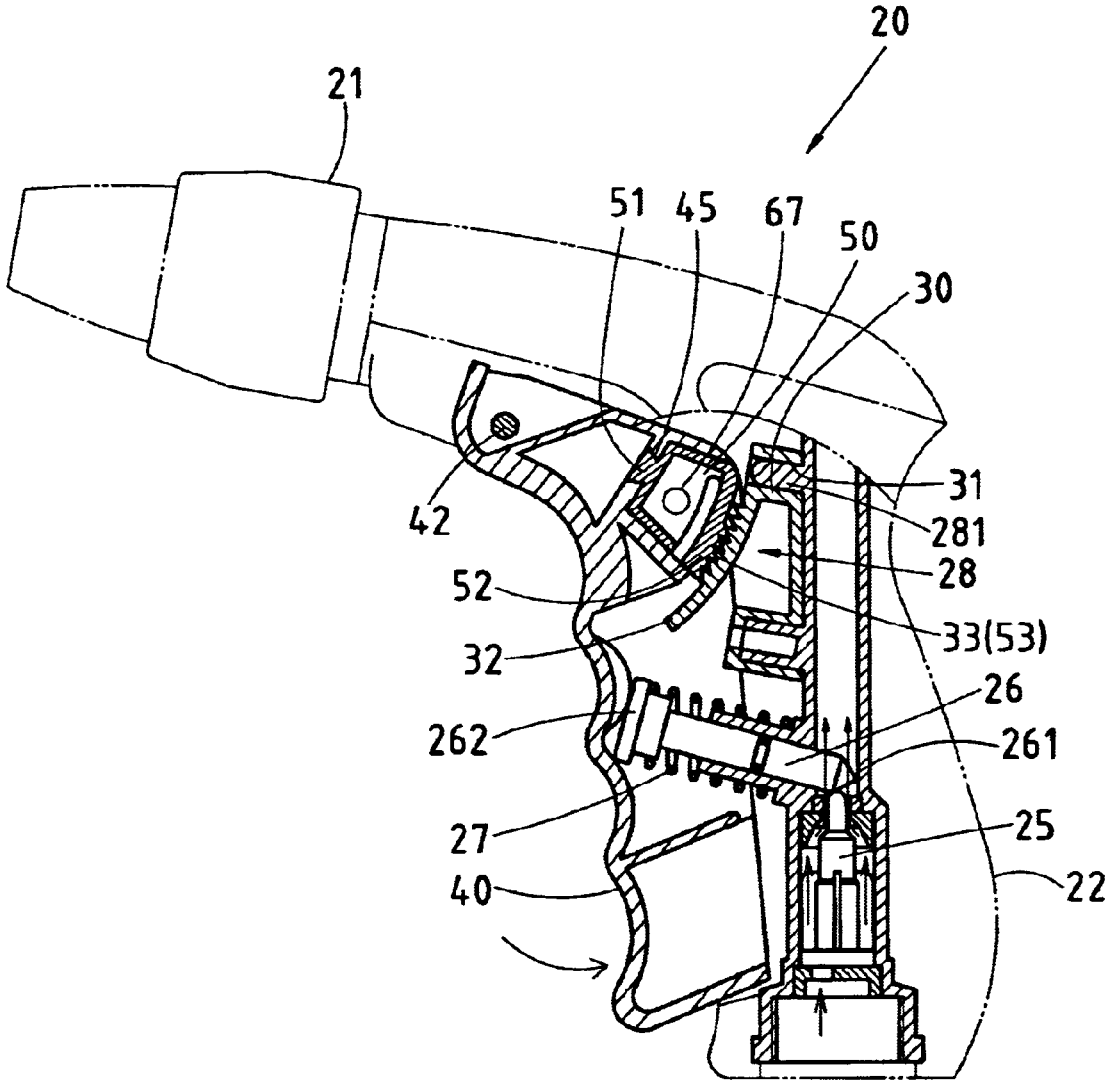
FIG. 6 shows a side sectional view of the first preferred embodiment of the present invention at work.

As shown in FIGS. 5 and 6, when the second shifting button 62 is pressed, the outer retaining seat 50 is actuated to slide in one direction, thereby resulting in engagement of the teeth 53 of the outer retaining seat 50 with the teeth 33 of the inner retaining seat 30. As a result, the control knob 40 is automatically located. The water is allowed to flow through the water channel 23 of the handle 22 without pressing the control knob 40. In another words, the control knob 40 is located jointly by the inner retaining seat 30 and the outer retaining seat 50.

Figure 7:
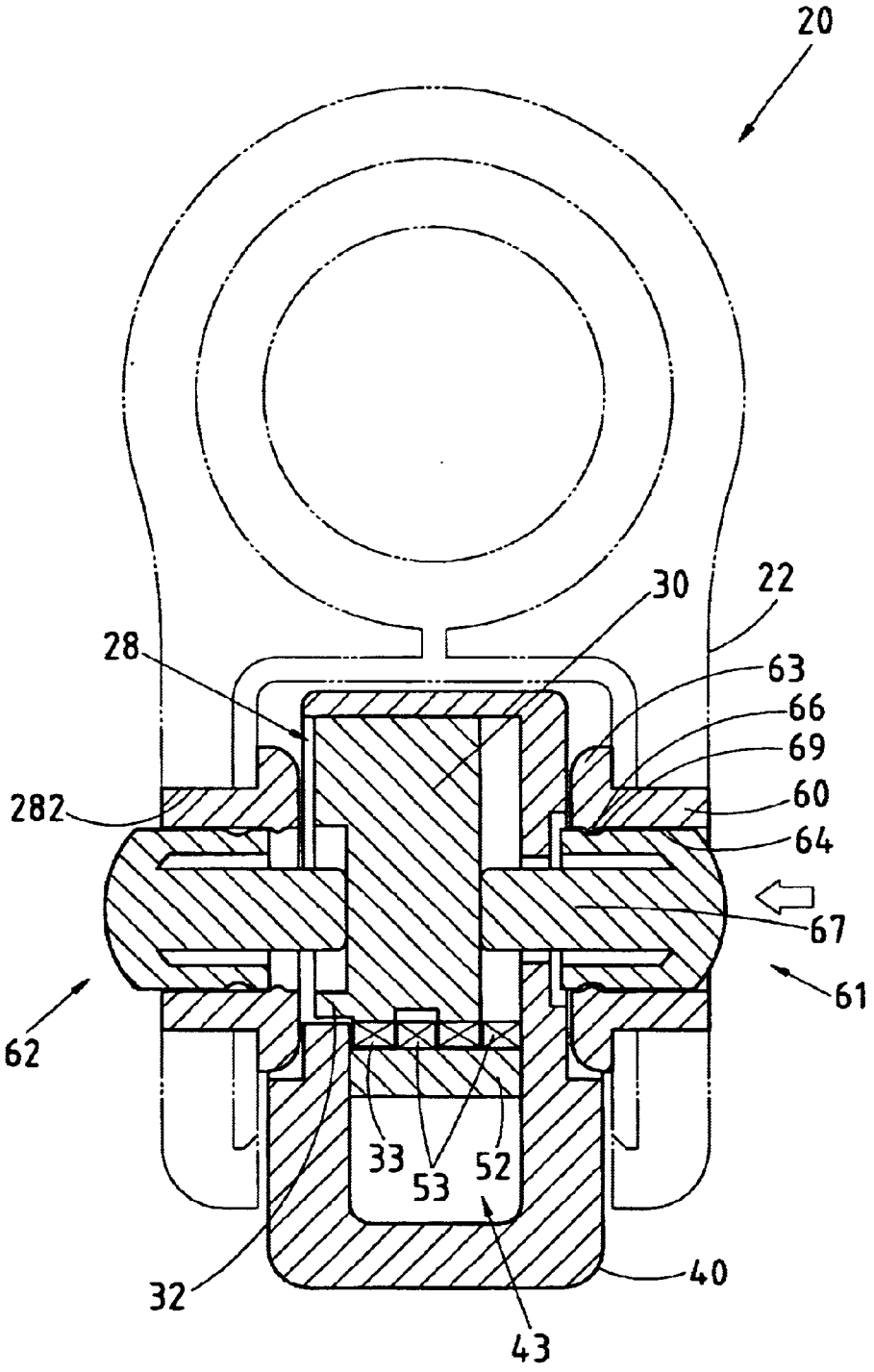
FIG. 7 shows another top sectional view of the first preferred embodiment of the present invention.
Figure 8:
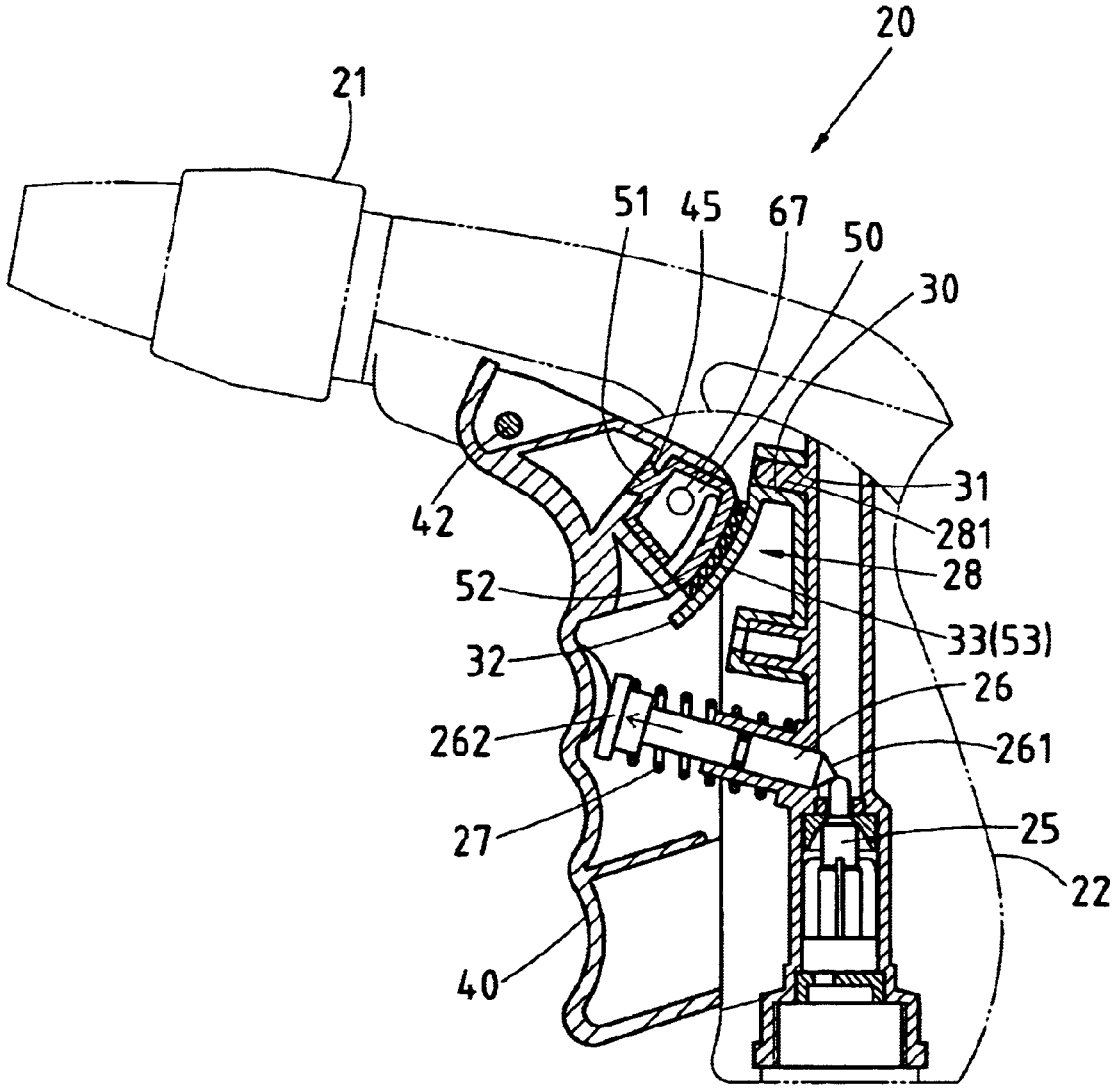
FIG. 8 shows a side sectional view of the first preferred embodiment of the present invention as shown in FIG. 7.
Figure 9:
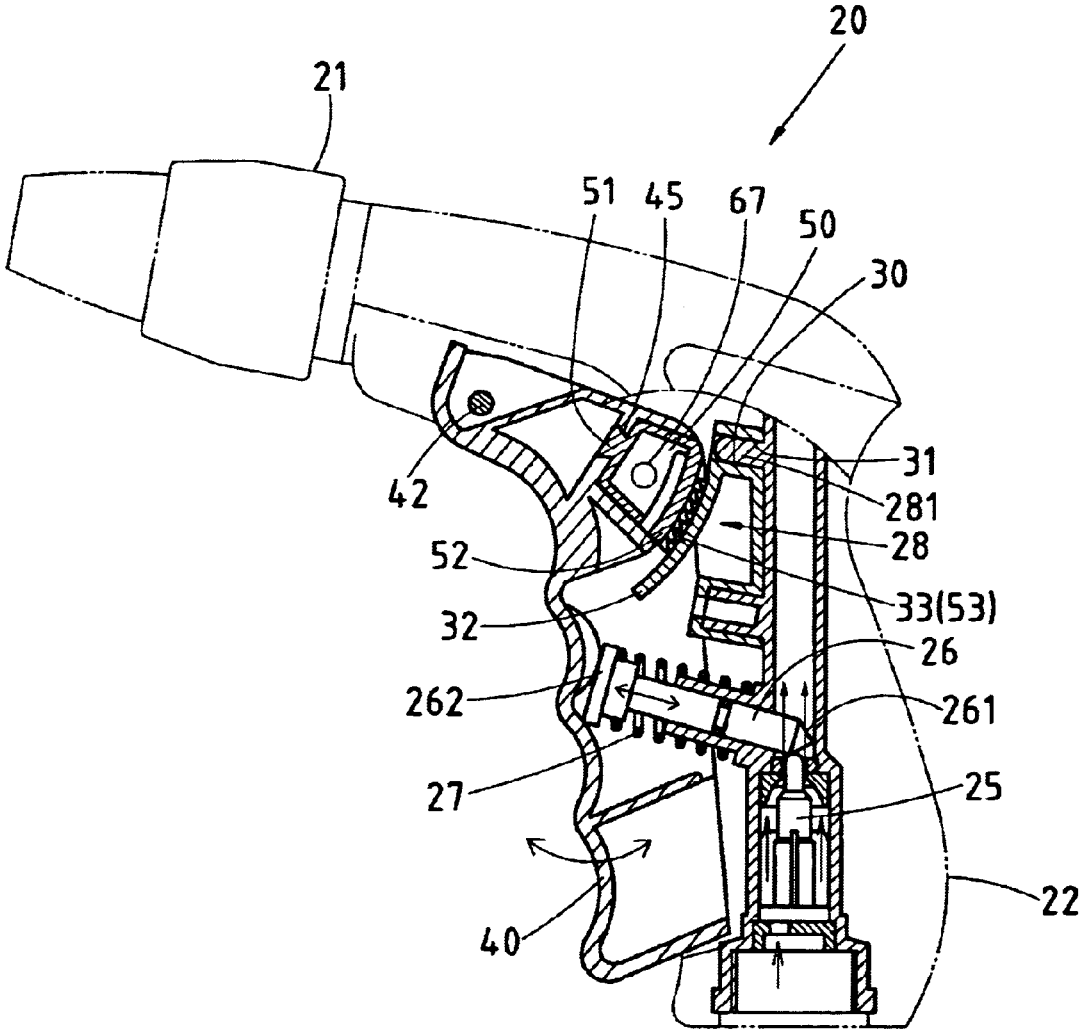
FIG. 9 shows another side sectional view of the first preferred embodiment of the present invention as shown in FIG. 7.

As illustrated in FIGS. 7 and 8, when the first shifting button 61 is pressed, the outer retaining seat 50 is actuated to slide in other direction, thereby resulting in disengagement of the teeth 53 of the outer retaining seat 50 with the teeth 33 of the inner retaining seat 30. In the meantime, the control knob 40 and the link rod 26 are forced by the spring force of the spring 27 to return to their original positions. The control knob 40 can be thus operated manually, as illustrated in FIG. 9, without participation of the shifting buttons 61 and 62.

Figure 10:
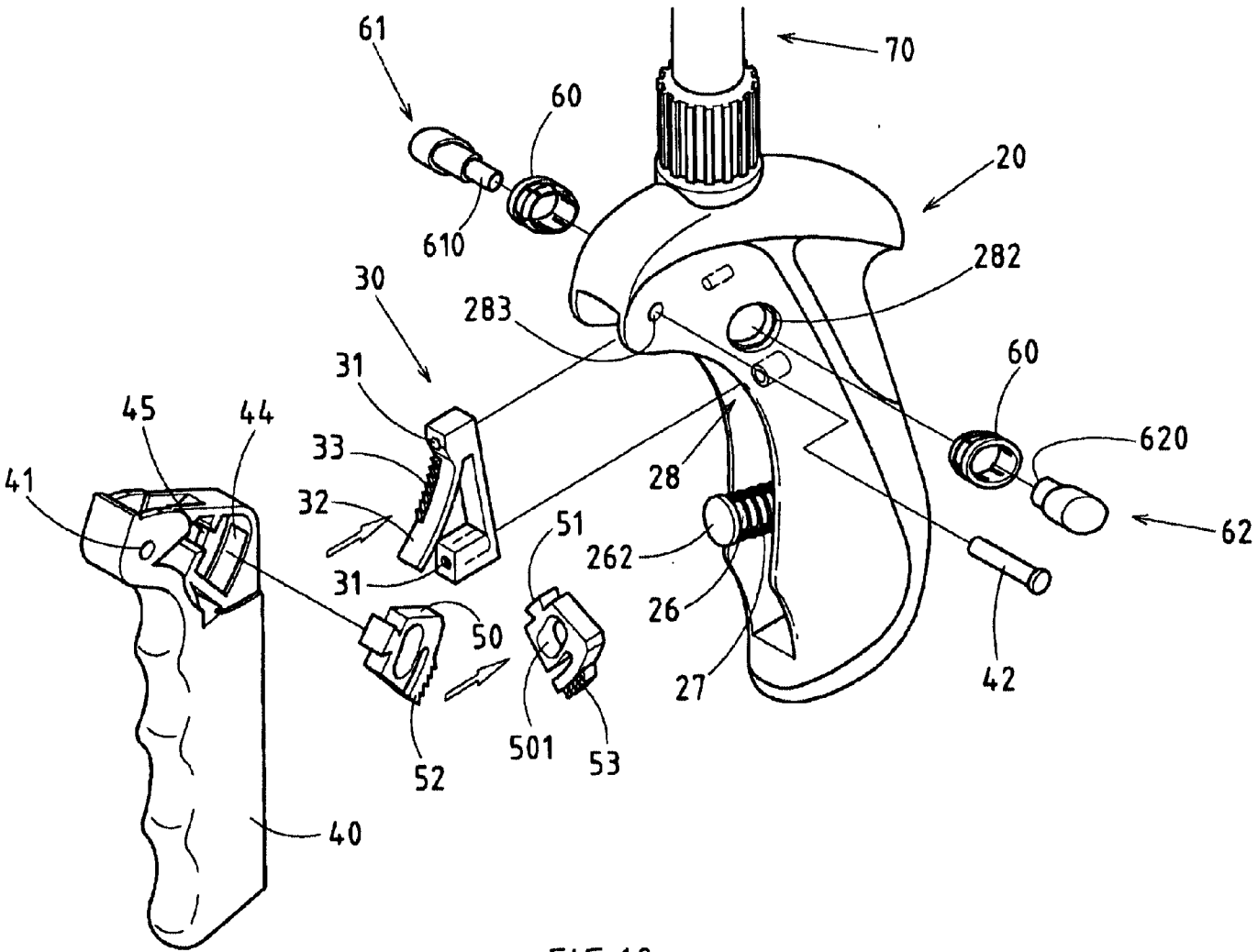
FIG. 10 shows an exploded perspective view of a second preferred embodiment of the present invention.
Figure 11:
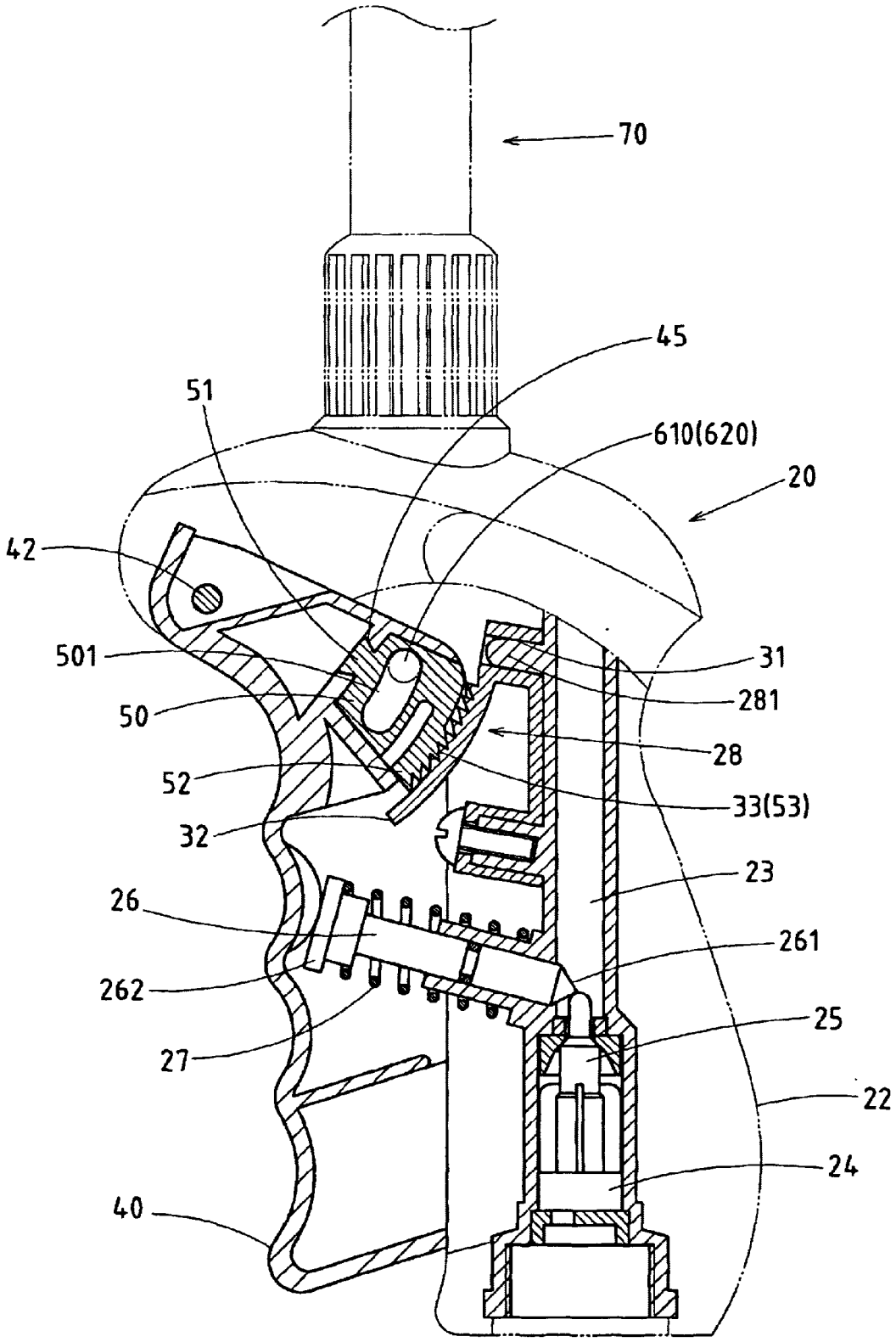
FIG. 11 shows a side sectional view of the second preferred embodiment of the present invention.
Figure 12:
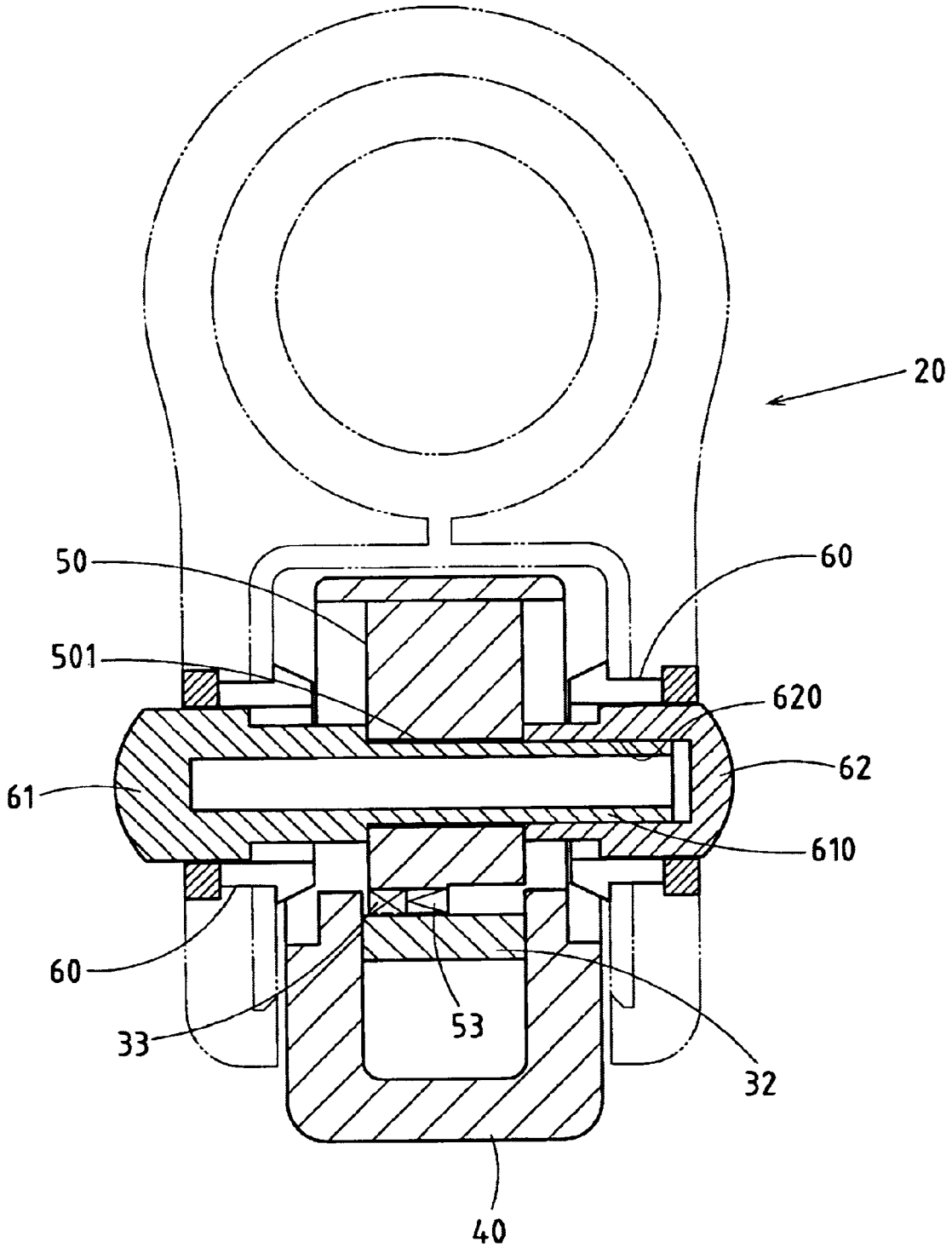
FIG. 12 shows a top sectional view of the second preferred embodiment of the present invention.
Figure 13:
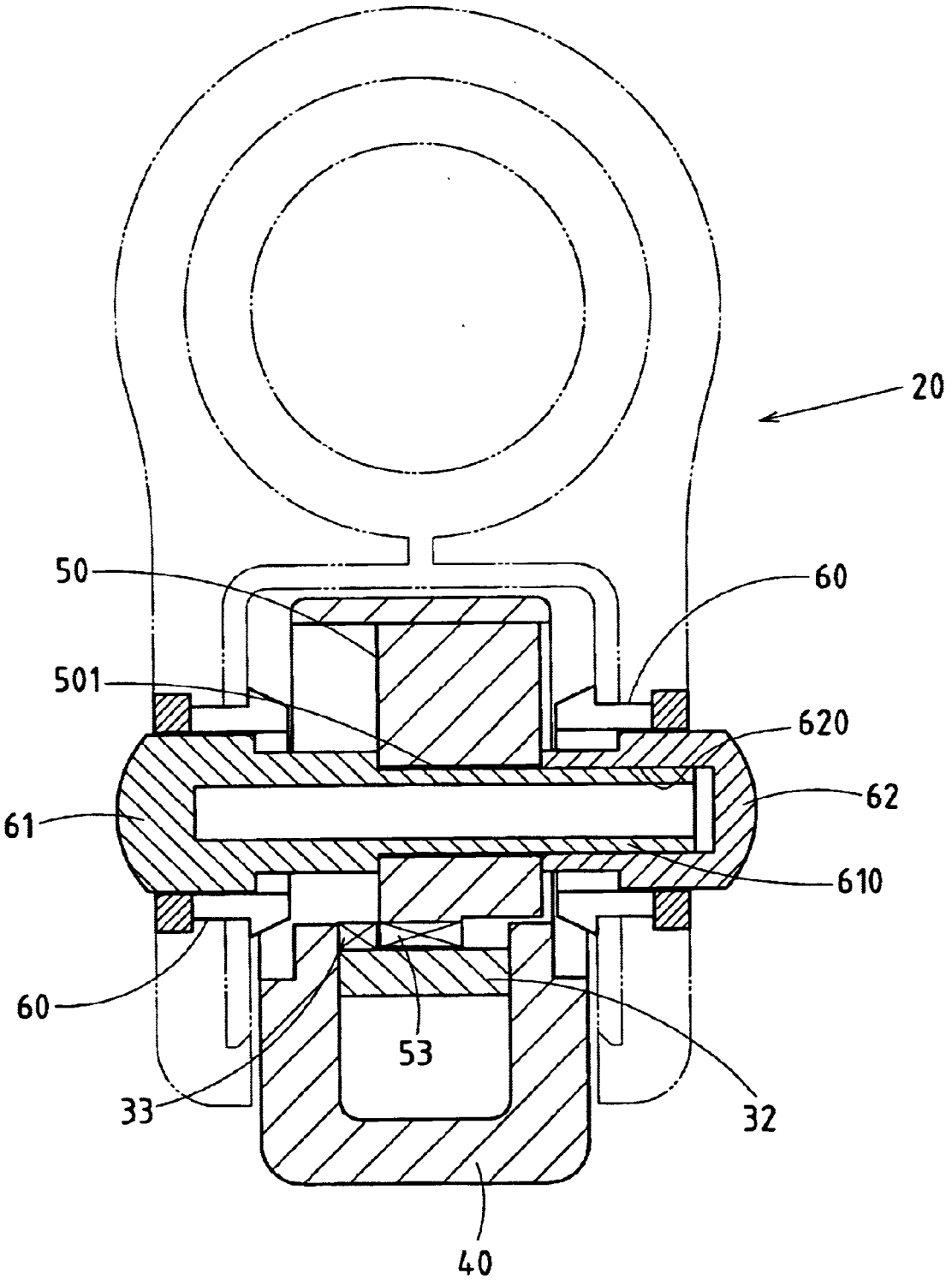
FIG. 13 shows another top sectional view of the second preferred embodiment of the present invention.
Figure 14:
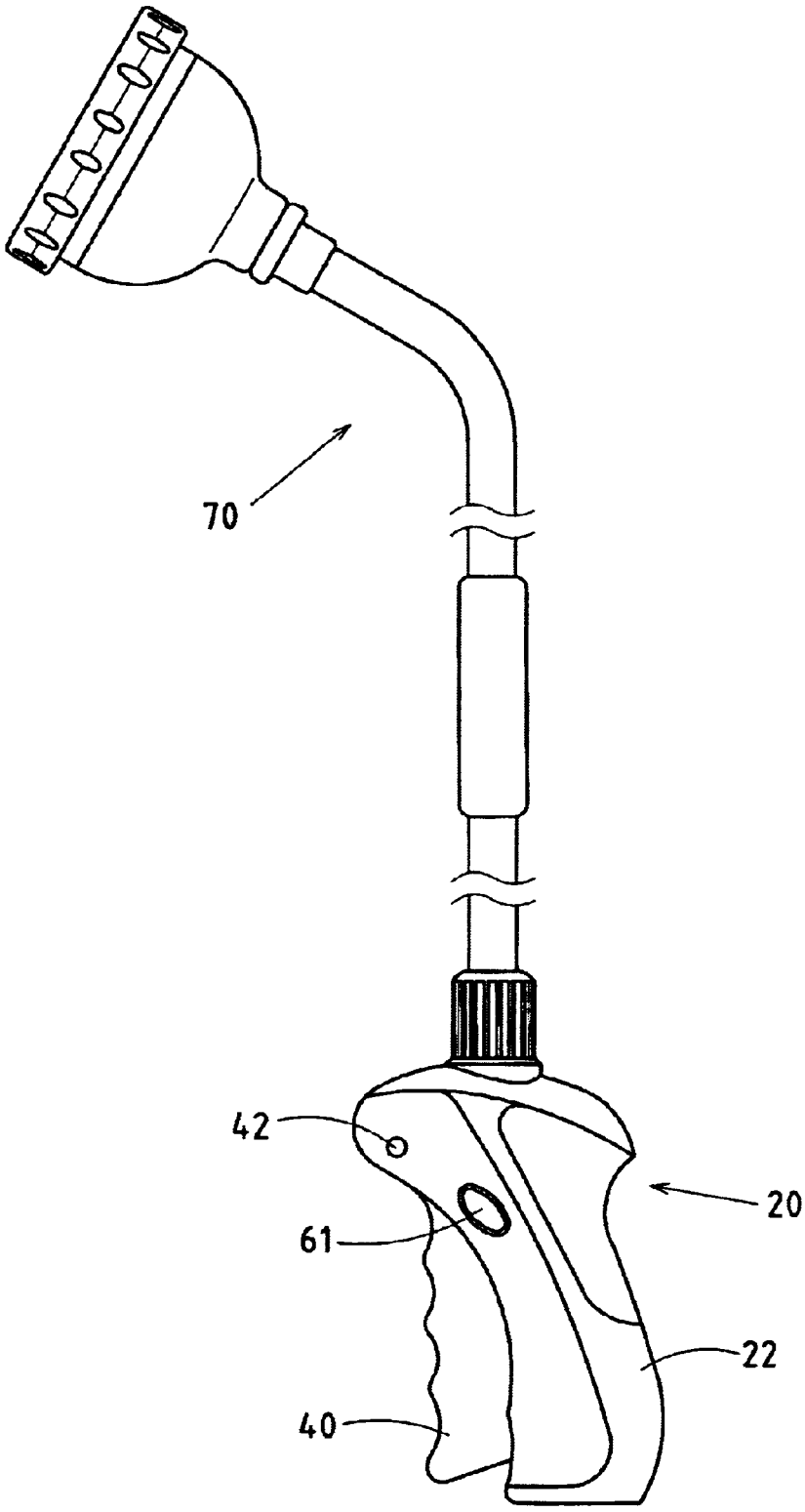
FIG. 14 shows a perspective view of the second preferred embodiment of the present invention.

As shown in FIGS. 10–14, a gardening pistol nozzle of the second preferred embodiment of the present invention is basically similar in construction to the first preferred embodiment described above with reference to FIGS. 2–9, with the difference being that the former comprises a nozzle head 70 which is aligned with the handle 22, and an outer retaining seat 50 which is slidably mounted on the first shifting button 61 and the second shifting button 62. The first shifting button 61 is provided with a solid projection 610, while the second shifting button 62 is provided with a hollow projection 620. The outer retaining seat 50 is provided with a through hole 501. The first shifting button 61 and the second shifting button 62 are joined together in the through holes 282 of the handle 22 such that the solid projection 610 of the first shifting button 61 is slidably received in the hollow projection 620 of the second shifting button 62. The outer retaining seat 50 is mounted on the hollow projection 620 of the second shifting button 62. As the shifting buttons 61 and 62 are pressed simultaneously, the solid projection 610 slides inside the hollow projection 620, thereby resulting in displacement of the outer retaining seat 50 on the hollow projection 620. The displacements of the outer retaining seat 50 bring about engagement of the teeth 53 of the outer retaining seat 50 with the teeth 33 of the inner retaining seat 30, as shown in FIG. 12, or disengagement of the teeth 53 of the outer retaining seat 50 with the teeth 33 of the inner retaining seat 30, as shown in FIG. 13. It must be noted here that the teeth 53 of the outer retaining seat 50 and the teeth 33 of the inner retaining seat 30 are arranged in one row, as shown in FIG. 10.

The embodiments of the present invention described above are to be regarded in all respects as being illustrative and nonrestrictive. Accordingly, the present invention may be embodied in other specific forms without deviating from the spirit thereof. The present invention is therefore to be limited only by the scope of the following claims.

I claim:

1. A pistol-type nozzle comprising:

a handle of a length and provided in an interior with a water channel extending along the longitudinal direction of said handle, said handle further provided in said water channel with a valve which is comprised of a valve rod for regulating the passage of water through said water channel, said handle further comprised of a link rod which is in contact at an inner end thereof with said valve rod;

a control knob fastened pivotally to said handle such that a side wall of said control knob comes in contact with an outer end of said link rod of said handle; and a nozzle head fastened to one end of said handle such that said nozzle head is in communication with said water channel of said handle;

wherein said handle is provided in proximity of the one end thereof with an assembly slot which is comprised of a locating projection, two through holes corresponding to each other, and two pivoting holes corresponding to each other, said handle further comprised of an inner retaining seat which is located in said assembly slot of said handle such that said locating projection of said assembly slot is fitted into a locating hole of said inner retaining seat whereby said inner retaining seat is comprised of a series of unidirectional teeth arranged in two or more rows, said handle further comprised of a first shifting element disposed in one of said two through holes of said assembly slot of said handle, and a second shifting element disposed in other one of said two through holes of said assembly slot of said handle whereby said first shifting element and said second shifting element have a projection; and wherein said control knob is comprised of a pivoting hole and is fastened pivotally in said assembly slot of said handle by a pivot which is received in said two pivoting holes of said assembly slot of said handle and said pivoting hole of said control knob, said control knob further comprised of an assembly slot which is comprised of a groove and is used to accommodate an outer retaining seat such that a block of said outer retaining seat is slidably fitted into said groove of said assembly slot of said control knob, and such that said outer retaining seat is pressed against by said projection of said first shifting element and by said projection of said second shifting element whereby said outer retaining seat is comprised of a series of teeth arranged in two or more rows, said teeth of said outer retaining seat being caused to engage with said teeth of said inner retaining seat at such time when said second shifting element is so pressed as to actuate said outer retaining seat to slide in one direction, thereby locating automatically said control knob, said teeth of said outer retaining seat being caused to disengage said teeth of said inner retaining seat at such time when said first shifting element is so pressed as to actuate said outer retaining seat to slide in other direction, thereby enabling said control knob to return to an original position thereof.

2. The pistol-type nozzle as defined in claim 1, wherein said assembly slot of said control knob is comprised of a dovetail groove; wherein said outer retaining seat is comprised of a dovetail block whereby said dovetail block is slidably fitted into said dovetail groove of said control knob.

3. The pistol-type nozzle as defined in claim 1, wherein said first shifting element is comprised of a solid projection; wherein said second shifting element is comprised of a hollow projection; wherein said outer retaining seat is comprised of a through hole and is slidably mounted on said hollow projection of said second shifting element, with said hollow projection being put through said through hole of said outer retaining seat, and with said solid projection of said first shifting element being slidably fitted into said hollow projection of said second shifting element.

4. The pistol-type nozzle as defined in claim 3, wherein said teeth of said outer retaining seat are arranged in a row; wherein said teeth of said inner retaining seat are arranged in a row.

* * * * *